US006866093B2

(12) United States Patent
Jonnalagadda et al.

(10) Patent No.: US 6,866,093 B2
(45) Date of Patent: Mar. 15, 2005

(54) ISOLATION AND FLOW DIRECTION/ CONTROL PLATES FOR A HEAT EXCHANGER

(75) Inventors: Rajanikant Jonnalagadda, Granger, IN (US); Brian J. Miller, Mishawaka, IN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/874,538

(22) Filed: Jun. 5, 2001

(65) Prior Publication Data

US 2002/0108741 A1 Aug. 15, 2002

Related U.S. Application Data

(60) Provisional application No. 60/268,295, filed on Feb. 13, 2001.

(51) Int. Cl.[7] ..... F28D 7/06; F28F 9/22

(52) U.S. Cl. ..... 165/159; 165/DIG. 415

(58) Field of Search ..... 165/159, 160, 165/DIG. 401, DIG. 405, DIG. 413, DIG. 415

(56) References Cited

U.S. PATENT DOCUMENTS

| | | | | | |
|---|---|---|---|---|---|
| 79,931 | A | * | 7/1868 | Agate | 165/160 |
| 1,289,350 | A | * | 12/1918 | Zimmermann | 165/160 |
| 1,401,717 | A | * | 12/1921 | Halleck | 165/160 |
| 1,489,932 | A | | 4/1924 | Dickey | |
| 1,979,975 | A | * | 11/1934 | Maniscalco | 165/160 |
| 2,147,719 | A | * | 2/1939 | Simons | 165/149 |
| 2,424,795 | A | | 7/1947 | Burns | |
| 2,530,443 | A | * | 11/1950 | Walker | 165/159 |
| 3,679,194 | A | | 7/1972 | Jones | |
| 3,724,212 | A | * | 4/1973 | Bell | 376/371 |
| 3,735,811 | A | * | 5/1973 | Moser et al. | 165/160 |
| 3,942,589 | A | * | 3/1976 | Opitzer | 165/157 |
| 4,016,929 | A | * | 4/1977 | Pfluger et al. | 165/159 |
| 4,114,684 | A | * | 9/1978 | Jenis et al. | 165/82 |
| 4,293,755 | A | | 10/1981 | Hill | |
| 4,357,214 | A | * | 11/1982 | La Mori et al. | 203/19 |
| 4,630,669 | A | | 12/1986 | Kessler | |
| 4,642,149 | A | * | 2/1987 | Harper | 165/159 |
| 4,744,368 | A | | 5/1988 | Brien | |
| 4,753,192 | A | | 6/1988 | Goldsmith | |
| 4,802,441 | A | | 2/1989 | Waugh | |
| 5,261,963 | A | | 11/1993 | Basta | |
| 5,645,694 | A | | 7/1997 | Stewart et al. | |
| 5,782,980 | A | | 7/1998 | Allen | |
| 5,814,192 | A | | 9/1998 | Pittmon et al. | |
| 5,819,683 | A | | 10/1998 | Ikeda | |
| 6,099,649 | A | | 8/2000 | Schmitt | |

FOREIGN PATENT DOCUMENTS

| | | | |
|---|---|---|---|
| GB | 572169 | A | 9/1945 |

* cited by examiner

*Primary Examiner*—Leonard R. Leo
(74) *Attorney, Agent, or Firm*—Larry J. Palguta

(57) ABSTRACT

A method and apparatus for controlling and isolating heat exchanger flows in a heat exchanger includes at least one isolation and flow direction control plate (40) having at least one fluid slot (45). The isolation and flow direction control plates (40, 41, 42) create a plurality of smaller heat exchangers 50 within a heat exchanger assembly (1). The isolation and flow direction control plates (40, 41, 42) permit fluid communication between the corresponding smaller heat exchangers (50) and individualized flow direction control over a shell side fluid flow between a shell side fluid inlet (11) and a shell side fluid outlet (12) of the heat exchanger assembly (1).

15 Claims, 4 Drawing Sheets

ISOLATION AND FLOW DIRECTION/ CONTROL PLATES FOR A HEAT EXCHANGER

This application claims priority on U.S. Provisional Application for "Isolation and Flow Direction/Control Plates of a Heat Exchanger," [No. 60/268,295 application No.] filed on Feb. 13, 2001, the entire contents of which are hereby incorporated by reference.

TECHNICAL FIELD AND INDUSTRIAL APPLICABILITY OF THE INVENTION

The present invention is generally directed to heat exchangers, and more particularly to a method and apparatus utilizing isolation and flow direction/control plates for a shell and tube type heat exchanger.

BACKGROUND OF THE INVENTION

Heating and cooling systems often contain a variety of heat exchangers for heating and cooling of liquids and gases, e.g. water, steam and/or air. In general, the various types of heat exchangers may be broken down into three main categories: Shell and Tube Heat Exchangers, Plate and Frame Heat Exchangers, and Air Coils.

Shell and Tube Heat Exchangers are the most common type of heat exchanger found in the background art. Normally, a bundle(s) of tubes is (are) enclosed within an outer shell. The tubes are joined to a tubesheet that prevents a fluid contained within the tube-side of the heat exchanger from becoming contaminated with a fluid contained in the shell side of the heat exchanger. Heat transfer is typically conducted across the tube walls separating the two fluids.

Baffle plates are commonly used to hold the tube bundles in their desired positions. The baffle plates will also serve the function of directing the shell side fluid across the exterior of the tube walls in order to achieve efficient heat transfer. The fluid passing within the tubes may make several passes through the heat exchanger in a common U-type arrangement involving U-shaped tube bundles and end plates/headers, or may make only a single pass through the heat exchanger.

The use of baffle plates on the shell side of heat exchangers has been in existence for many years. These baffle plate arrangements may utilize circular plates fitted within the shell enclosure that additionally have holes cut within the surface of the plate to secure the tubes that pass therethrough.

FIG. 1 is a side elevation view of a heat exchanger according to the background art. FIG. 2 is an enlarged, end view of a baffle plate for the heat exchanger shown in FIG. 1. A shell and tube heat exchanger 1 incorporating a U-shaped tube bundle 20 is generally shown in FIG. 1. A plurality of tubes 21 is provided connecting a tube side fluid flow through a tube side fluid inlet 22 and a tube side fluid outlet 23. A shell 10 having a shell side fluid inlet 11 and shell side fluid outlet 12 encloses the tube bundle therein. A baffle plate 30 having a plurality of tube holes 35 cut therein is shown in more detail in FIG. 2.

The baffle arrangement shown in FIG. 1 achieves a series of four, flow diversions (changes in flow direction) that essentially imparts a sinusoidal flow stream to the shell side fluid. This is achieved through the use of four semi-circular baffle plates 30 that extend only partially through the width of the shell 10. The baffle plates 30 move fluid in a sinusoidal (cross-sectional) manner on the shell side of the heat exchanger and thereby achieve longer contact time for the shell side fluid with the fluid contained within the tubes.

Depending on the arrangement desired in the heat exchanger, the resulting shell side fluid flow can be either parallel flow (in parallel with and in the same flow direction of tube side flows), counterflow (in parallel with but counter to the flow direction of tube side flows), or cross-flow (tangential or normal to the direction of tube side flows). As seen in FIG. 1, the fluid within the tube side of the heat exchanger 1 enters at the tube side fluid inlet 22 and exits at the tube side fluid outlet 23, thereby making two passes through the heat exchanger 1.

A first tube side flow path is defined by and extends from, as viewed from left to right in FIG. 1, the tube side fluid inlet 22 to a tube side header 24. A second tube side flow path extends from the tube side header 24 to the tube side fluid outlet 23. Therefore, fluid flow on the shell side of the heat exchanger flowing from left to right in FIG. 1 flows in the same direction (parallel flow) as fluid in the first tube side flow path and counter (counterflow) to the flow direction in the second tube side flow path. However, the baffle plates 30 impart a partial cross-flow of the shell side flow path with respect to the tube side flows.

One shell and tube type heat exchanger is currently used for the cooling of CVD/CVI furnaces. This type of heat exchanger may have multiple banks of heat exchangers with several tube side fluid inlets and tube side fluid outlets. The heat exchanger may also have a turbine installed in the same heat exchanger housing that draws upon fluid leaving the shell side fluid outlet of the heat exchanger. The heat exchanger may even be separated from the turbine inlet using a circular baffle plate, e.g. having a hole in the center of the plate for permitting controlled flow to the turbine inlet.

However, this type of arrangement does not permit isolation or control of the individual banks of heat exchangers when multiple tube banks are utilized in the heat exchanger.

SUMMARY OF THE PRESENT INVENTION

The present invention overcomes the shortcomings associated with the background art and achieves other advantages not realized by the background art.

The present invention, in part, is a recognition that it will be advantageous to direct and control heat exchanger cross-flow on the shell side between small heat exchangers in a multi-bank heat exchanger arrangement.

The present invention, in part, is a recognition that it is desirable to control and balance pressure drops across both shell and tube side flows of a heat exchanger.

The present invention, in part, provides a heat exchanger assembly comprising a shell; a plurality of tubes; a shell side fluid inlet; a shell side fluid outlet; at least one tube side fluid inlet; at least one tube side fluid outlet; and at least one isolation and flow direction control plate positioned in the shell of the heat exchanger assembly for creating a plurality of smaller heat exchangers, each of said isolation and flow direction control plates including at least one fluid slot for permitting a passage of a shell side fluid flow through said isolation and flow direction control plate.

The present invention, also in part, provides a method of controlling a fluid flow for a heat exchanger assembly comprising creating a plurality of smaller heat exchangers by providing at least one isolation and flow direction control plate in a shell side of the heat exchanger assembly; and isolating and directing the fluid flow on the shell side of the heat exchanger assembly between each of said smaller heat exchangers.

The present invention, also in part, provides an isolation and flow direction control plate for controlling fluid flow on a shell side of a shell and tube heat exchanger comprising a base plate; and at least one fluid slot for permitting a passage of a shell side fluid flow through said isolation and flow direction control plate.

Advantages of the present invention will become more apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus do not limit the present invention.

FIG. 6(*b*) is an enlarged view of a portion of second isolation and flow direction control plate shown in FIG. 5; and FIG. 6(*c*) is an enlarged view of a portion of third isolation and flow direction control plate shown in FIG. 5.

DETAILED DESCRIPTION OF THE PREFERRED EMBODIMENTS

Figure 1:
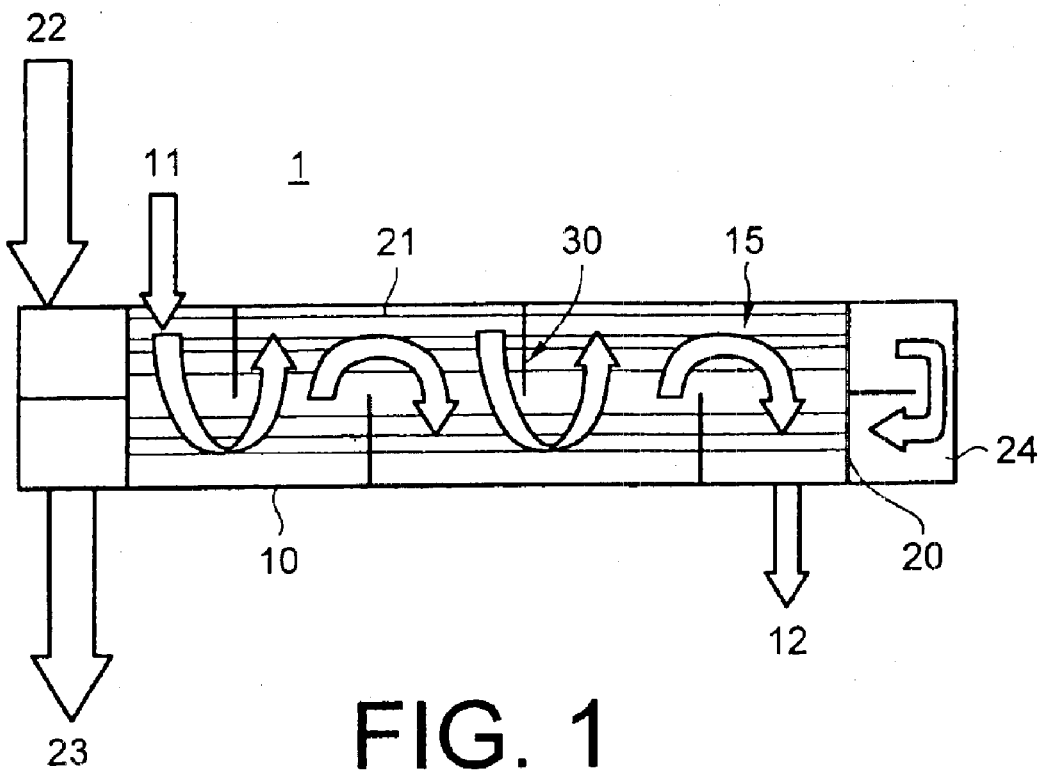
FIG. 1 BACKGROUND ART
FIG. 1 is a side elevation view of a heat exchanger according to the background art.
Figure 2:
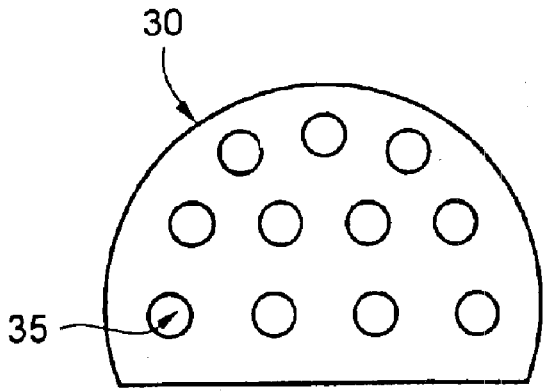
FIG. 2 BACKGROUND ART
FIG. 2 is an enlarged, end view of a baffle plate for the heat exchanger shown in FIG. 1.
Figure 3:
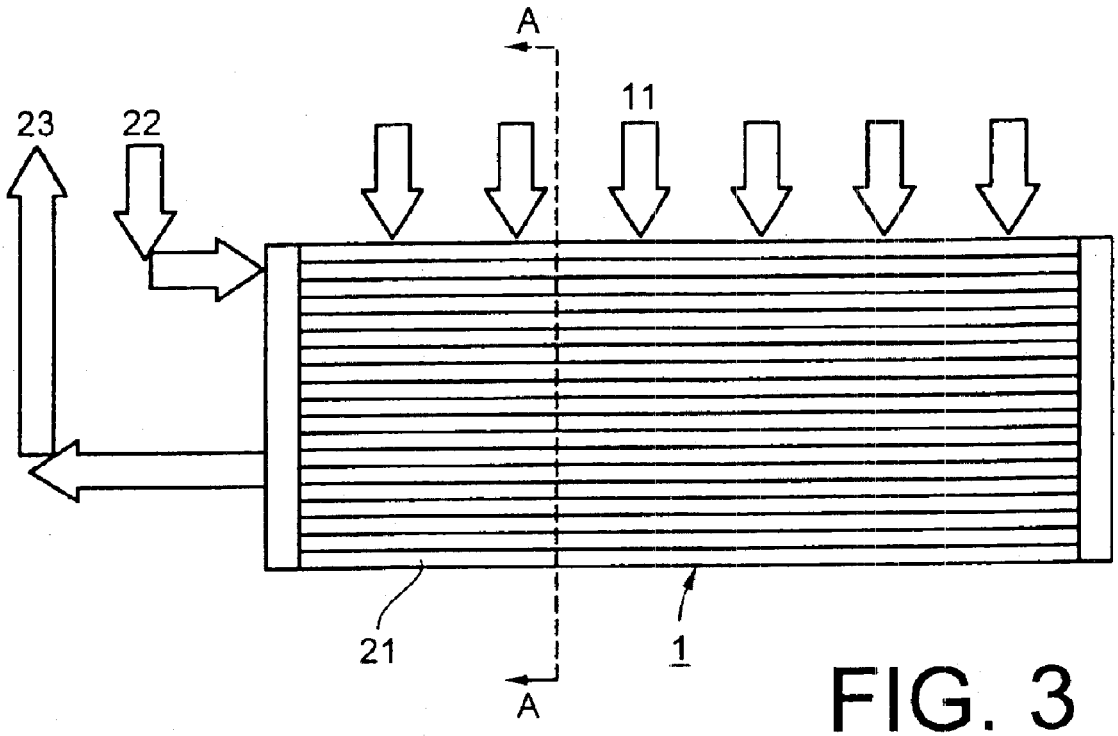
FIG. 3 is a side view of a shell and tube heat exchanger according to an embodiment of the present invention.
Figure 4:
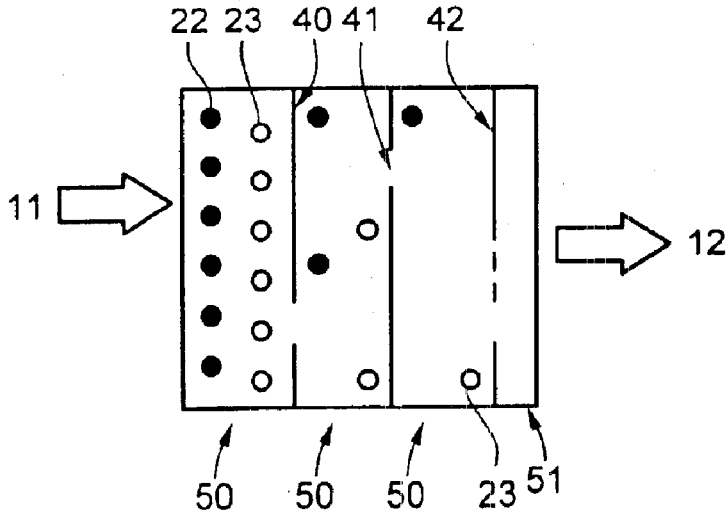
FIG. 4 is a cross-sectional view taken along line A—A in FIG. 3.
Figure 5:
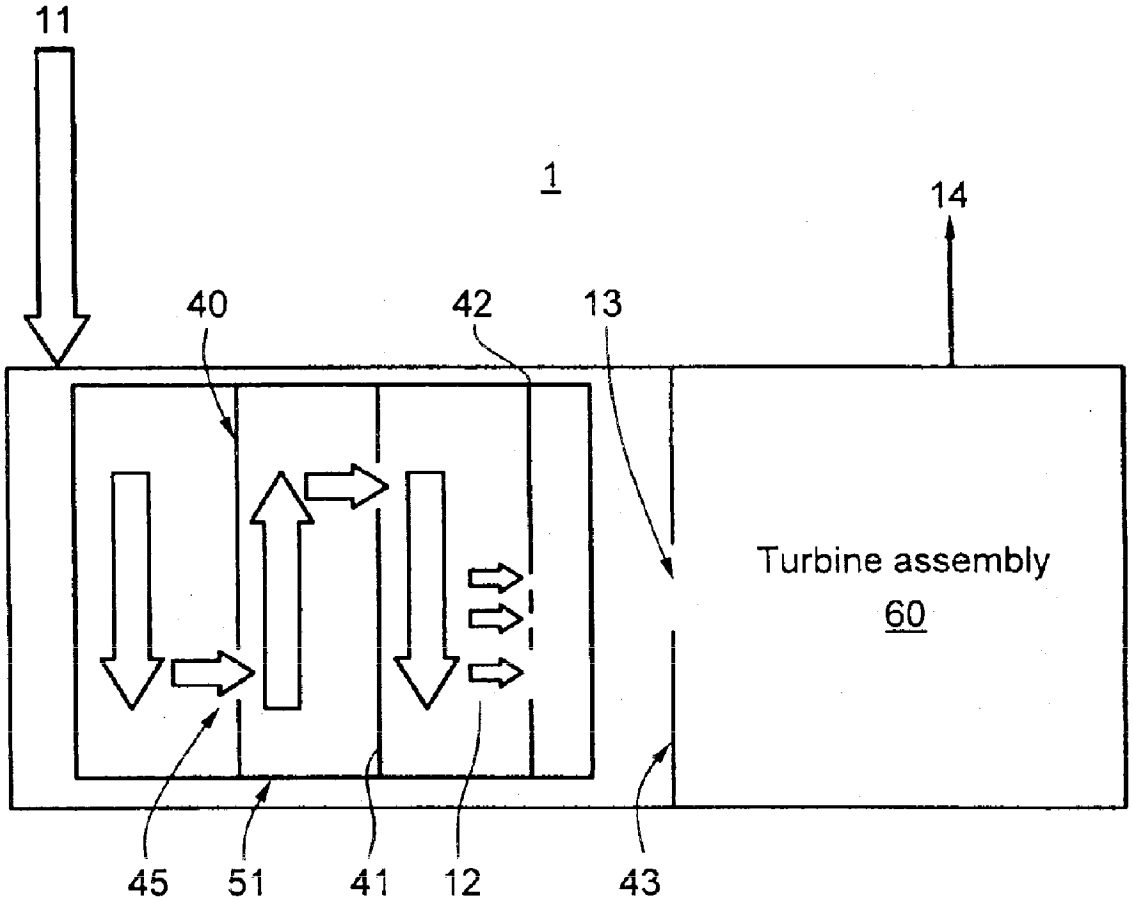
FIG. 5 is an end view of a heat exchanger according to an embodiment of the present invention.
Figure 6A:
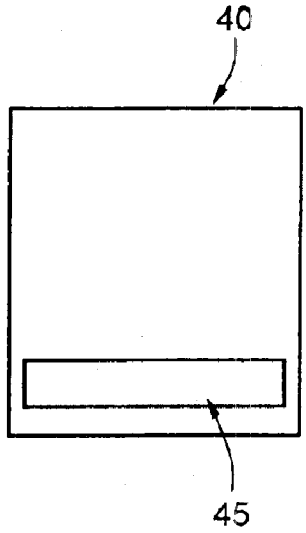
FIG. 6(*a*) is an enlarged view of a portion of first isolation and flow direction control plate shown in FIG. 5.
Figure 6B:
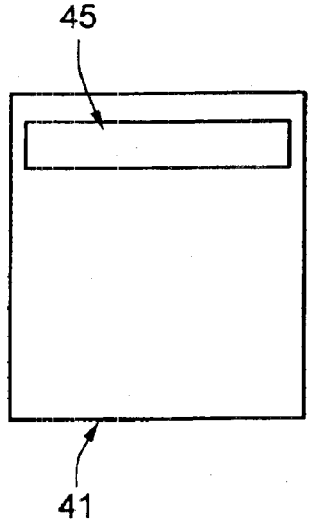
Figure 6C:
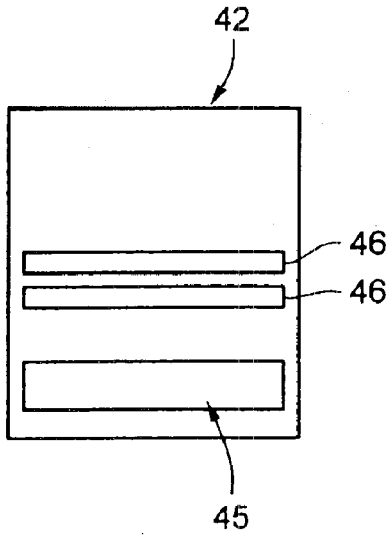

The present invention will now be described in detail with reference to the accompanying drawings. FIG. 3 is a side view of a shell and tube heat exchanger according to an embodiment of the present invention. FIG. 4 is a cross-sectional view of the heat exchanger of FIG. 3. FIG. 5 is an end view of a heat exchanger according to an embodiment of the present invention. FIG. 6(*a*) is an enlarged view of a portion of a first isolation and flow direction control plate shown in FIG. 5. FIG. 6(*b*) is an enlarged view of a portion of a second isolation and flow direction control plate shown in FIG. 5. FIG. 6(*c*) is an enlarged view of a portion of a third isolation and flow direction control plate shown in FIG. 5.

FIG. 3 is a side view of a shell and tube heat exchanger assembly according to an embodiment of the present invention. FIG. 4 is a cross-sectional view of the heat exchanger assembly of FIG. 3. A shell side fluid flow inlet 11 is provided in a cross-flow arrangement with respect to a tube side fluid flow inlet 22 and tube side fluid flow outlet 23. A shell side fluid flow 12 exits the shell and tube heat exchanger after heat transfer is completed with several passes of tubes 21.

FIG. 5 is an end view of a heat exchanger assembly 1 according to an embodiment of the present invention. A plurality of isolation and flow direction control plates (IFDC plates) 40, 41, 42 are provided that separate the several banks of tubes 21 into a plurality of smaller, isolated heat exchangers 50. In a preferred embodiment, each of the isolation and flow direction control plates 40, 41, 42 is formed from a rectangular base plate. However, one of skill in the art will appreciate that the actual shape of the base plate may vary depending on the shape of the shell side of the heat exchanger assembly that the IFDC plate is intended to fit within.

A first isolation and flow direction control plate 40, a second isolation and flow direction plate 41 and a third isolation and flow direction control plate 42 are provided in the embodiment shown in FIG. 4 and FIG. 5. However, one of skill in the art will appreciate that the number of IFDC plates 40, 41, 42 can be increased or decreased in order to form alternative (more or less, respectively) multiples of heat exchangers 50 and in accordance with the desired control of shell side fluid path.

FIG. 5 shows a heat exchanger assembly 1 integrated with a turbine assembly 60. The turbine's fluid inlet 13 corresponds to the shell side fluid outlet 12 of the heat exchanger assembly. The shell side fluid exiting the heat exchanger assembly 1 first passes through the first IFDC plate 40, the second IFDC plate 41 and the third IFDC plate 42. A final circular baffle 43 is provided for controlling the introduction of the fluid to the turbine assembly 60. The fluid exits the turbine assembly 60 through the turbine fluid outlet 14.

As seen in FIG. 6(*a*) through FIG. 6(*c*), each of the IFDC plates 40, 41, 42 is provided with a rectangular fluid slot 45 positioned in a portion, e.g. at various heights or levels, of each respective IFDC plate. This deliberate positioning of the rectangular slots 45 permits a controlled introduction of shell side fluid flow to a successive heat exchanger 50. The rectangular fluid slots 45 are individually sized and positioned to achieve a desired pressure drop, extend or retard the period of time available for heat transfer in each individual heat exchanger 50, and to control the direction or point of introduction of shell side fluid flow to each successive heat exchanger 50.

In contrast to the semi-circular or circular baffle plates 30 of the background art having tubular holes 35 for engaging tubes 21 of a heat exchanger, the present invention utilizes a series of IFDC plates 40, 41, 42 having rectangular fluid slots 45 that permit greater control over the shell side fluid flow. As seen in FIG. 6(*c*), IFDC plates 42 can also be provided with a plurality of rectangular slots 45, including alternatively sized rectangular slots 46. The alternatively sized rectangular slots 46 can be larger or smaller based on desired heat transfer effects and acceptable pressure losses.

As seen in FIG. 4 through FIG. 5, the IFDC plates 40, 41, 42 are positioned normal to the shell side fluid inlet and outlet in a preferred embodiment, e.g. in a series of cross-flow type heat exchangers 50. Accordingly, baffle plates 30 of the background art, although different than the present invention, can be readily incorporated into one or several of the individual heat exchangers 50 created by the application of the IFDC plates 40, 41, 42.

Materials for the IFDC plates 40, 41, 42 of the present invention can be virtually any material suitable for baffle plates 30 of the background art. Some exemplary materials are various arrangements of CuNi, Bronze, Steel (including, but not limited to stainless steel, forged and/or cast steel), and Titanium. The IFDC plates and their respective fluid slots 45, 46 can be machined, cast or forged.

Although the fluid slots 45 are depicted as being rectangular in shape, other shapes can be readily incorporated into the present embodiments, including but not limiting to triangular, trapezoidal, circular, or other polygonal slot shapes permitting sufficient flow control (e.g., area of slot, pressure drop, location/positioning of slot on IFDC plate).

One of skill in the art will appreciate that the actual heat exchanger design will vary depending upon the types and quantities of fluids/systems involved, e.g. type of fluid, viscosity, thermal conductivity, etc . . . , system temperatures and pressures, allowable pressure drops, weight and material considerations and preferences, and/or fouling factor/flow resistance considerations. Further, several additional industry technical standards and/or codes may govern the applicable commercial use, design or implementation of heat exchangers incorporating the present invention.

A method according to the present invention will now be described with reference to the accompanying drawings and foregoing description of FIGS. 3–6(*c*). The present invention is directed toward a method of controlling and isolating shell side fluid in a heat exchanger(s), particularly in a cross flow type shell and tube heat exchanger.

One of skill in the art will appreciate that the IFDC plates of the present invention can be incorporated during the initial design and manufacture of a heat exchanger assembly 1, however, it will also be possible to retrofit or upgrade an existing heat exchanger assembly with IFDC plates to create a series of smaller, heat exchangers.

In general, the method of controlling a fluid flow for a heat exchanger assembly 1 includes creating a plurality of smaller heat exchangers 50 by providing at least one isolation and flow direction control plate 40 in a shell side 22, 23 of the heat exchanger assembly 1 and isolating and directing the fluid flow on the shell side of the heat exchanger assembly 1 between each of the smaller heat exchangers 50. In a preferred embodiment, the heat exchanger assembly is a shell and tube heat exchanger assembly 1, however it will be possible to incorporate the present invention into other types of heat exchanger designs.

Each of the isolation and flow direction control plates includes at least one fluid slot for permitting the fluid flow to pass through each of the isolation and flow direction control plates. Although the slots are rectangular slots in a preferred embodiment, as aforementioned, other shapes can be incorporated into the present invention. Further, a designer may wish to vary a period of time or residence time during which the fluid flow on the shell side 22, 23 of the heat exchanger assembly 1 resides in the smaller heat exchangers 50. This can be accomplished by the sizing and positioning of each of the IFDC plates 40, 41, 42.

As aforementioned, one of the design considerations with respect to the isolation and flow direction control plates 40, 41, 42 is a balance between effective heat transfer and acceptable pressure losses. One of skill in the art will appreciate that pressure drop considerations on both the shell and tube side of the heat exchanger will significantly impact heat exchanger sizing, required pumping capacity and will often be a necessary design tradeoff between idealized heat transfer rates, or more specifically, a desirable heat transfer film coefficient. The film coefficient may be influenced by such factors as fluid velocity, material selection and fluid tube diameter.

Tube side pressure drops are the realized pressure losses experienced across the tube side fluid inlet 22 and the tube side fluid outlet 23. These losses may be associated with pressure losses due to flow acceleration, deceleration, changes in direction, or frictional pressure losses (scaling or tube material).

Shell side pressure drops are the realized pressure losses experienced across the shell side fluid inlet 11 and the shell side fluid outlet 12. These pressure losses may be associated with fluid velocity (flow acceleration and deceleration), pressure loss coefficients for each of the fluid slots 45 of the IFDC plates 40, 41, 42, pressure loss coefficients due to flow area expansion and contraction and flow redirection, tube geometry (pitch, length and diameter), and fluid characteristics.

When either of the shell side or tube side fluid flows are subdivided with the use of the IFDC plates of the present invention, the total or sum of the individual shell or tube side pressure drops in each of the individual shell/tube stages will be the total realized pressure losses. One of skill in the art will appreciate that the pressure loss coefficients for each of the fluid slots 45 and IFDC plates 40, 41, 42 will vary depending on the surface area of each of the slots 45 or plates. Further, the shape and edges of the slots 45 may be chamfered, angled or arcuately shaped in order to prevent flow erosion and smoother flow transitions.

Accordingly, the method and apparatus of the present invention further includes calculating a plurality of acceptable pressure losses through each of the smaller heat exchangers; and sizing the isolation and flow direction control plates to permit fluid flow within the calculated acceptable pressure losses.

Further examples of suitable and applicable materials, heat exchanger design considerations and steps, such as the use of either of LMTD (Log Mean Temperature Difference) or NTU (Number of Transfer Units) Methods, modeling software and iterative solvers, and potential applications of the present invention are described in the many of the standards of the Tubular Exchanger Manufacturers Association, particularly the "Standards of the Tubular Exchanger Manufacturers Association, $8^{th}$ Edition (July 1999)," and the American Society of Mechanical Engineers; the entirety of each of which is hereby incorporated by reference. As such, the actual configurations shown in the accompanying figures are presented by way of example, and are not intended to limit the invention to the specific arrangement(s) presented.

What is claimed is:

1. A heat exchanger assembly comprising:

a shell having a shell side fluid path;

a plurality of tubes;

a shell side fluid inlet;

a shell side fluid outlet, wherein a shell side fluid is capable of flowing between said shell side fluid inlet and said shell side fluid outlet in said shell side fluid path extending therebetween;

at least one tube side fluid inlet;

at least one tube side fluid outlet, said tubes extending between said tube side fluid inlet and said tube side fluid outlet, wherein said shell side fluid path extending between said shell side inlet and said shell side fluid outlet is arranged in a cross flow fluid arrangement with respect to each of said tube side fluid inlets and said tubes; and a plurality of isolation and flow direction control plates positioned normal to said shell side fluid path and in parallel with said tube side fluid inlet and said tubes in the shell of the heat exchanger assembly for creating adjacent smaller heat exchangers, each of said isolation and flow direction control plates including at least one fluid slot for permitting fluid communication between corresponding adjacent smaller heat exchangers, said fluid slots extending normal to said shell side fluid path and in parallel with said tubes, wherein said isolation and flow direction control plates include a first isolation and flow direction control late having at least one of said fluid slots, and a second isolation and flow direction control plate having at least one of said fluid slots, wherein said second isolation and flow direction control plate has a different number of said fluid slots than said first isolation and flow direction control plate.

2. The heat exchanger assembly according to claim 1, wherein each of said isolation and flow direction control plates is a rectangular shaped plate.

3. The heat exchanger assembly according to claim 2, wherein each of said fluid slots is a rectangular shape fluid slot.

4. The heat exchanger assembly according to claim 1, wherein each of said fluid slots is a rectangular shaped fluid slot.

5. The heat exchanger assembly according to claim 1, wherein said tubes form at least one U-shaped tube bundle.

6. The heat exchanger assembly according to claim 1, said isolation and flow direction control plates having a pressure loss coefficient, said pressure loss coefficients contributing to acceptable pressure loss for each of said smaller heat exchangers.

7. The heat exchanger assembly according to claim 1, wherein said plurality of fluid slots includes slots having different cross sectional areas.

8. The heat exchanger assembly according to claim 7, wherein said at least one of said plurality of said isolation and flow direction control plates including said fluid slots is positioned adjacent to said shell side fluid outlet.

9. A turbine assembly having an integral heat exchanger assembly, said heat exchanger comprising:

a shell having a shell side fluid path;

a plurality of tubes;

a shell side fluid inlet;

a shell side fluid outlet, wherein a shell side fluid is capable of flowing between said shell side fluid inlet and said shell side fluid outlet in said shell side fluid path extending therebetween, wherein said shell side fluid outlet is an inlet to said turbine assembly;

at least one tube side fluid inlet;

at least one tube side fluid outlet, said tubes extending between said tube side fluid inlet and said tube side fluid outlet, wherein said shell side fluid path extending between said shell side inlet and said shell side fluid outlet is arranged in a cross flow fluid arrangement with respect to each of said tube side fluid inlets and said tubes; and a plurality of isolation and flow direction control plates positioned normal to said shell side fluid path and in parallel with said tube side fluid inlet and said tubes in the shell of the heat exchanger assembly for creating adjacent smaller heat exchangers, each of said isolation and flow direction control plates including at least one fluid slot for permitting fluid communication between corresponding adjacent smaller heat exchangers, said fluid slots extending normal to said shell side fluid path and in parallel with said tubes and wherein said plurality of isolation and flow direction control plates includes a first isolation and flow direction control plate having at least one of said fluid slots, and a second isolation and flow direction control plate having at least one of said fluid slots, wherein said second isolation and flow direction control plate has a different number of said fluid slots an said first isolation and flow direction control plate.

10. A method of controlling a fluid flow for a heat exchanger assembly, said heat exchanger assembly including a shell having a shell side fluid path; a plurality of tubes; a shell side fluid inlet; a shell side fluid outlet, wherein a shell side fluid is capable of flowing between said shell side fluid inlet and said shell side fluid outlet in said shell side fluid path extending therebetween; at least one tube side fluid inlet; at least one tube side fluid outlet, said tubes extending between said tube side fluid inlet and said tube side fluid outlet, wherein said shell side fluid path extending between said shell side inlet and said shell side fluid outlet is ranged in a cross flow fluid arrangement with respect to each of said tube side fluid inlets and said tubes; said method comprising:

creating a plurality of smaller heat exchangers by providing a plurality isolation and flow direction control plates in a shell side of the heat exchanger assembly, wherein each of said isolation and flow direction control plates includes at least one fluid slot for permitting the fluid flow to pass through said isolation and flow direction control plate, said fluid slots extending normal to said shell side fluid path and in parallel with said tubes, wherein said isolation and flow direction control plates provided to create the plurality of smaller heat exchangers include a first isolation and flow direction control plate having at least one of said fluid slots, and a second isolation and flow direction control plate having at least one of said fluid slots, wherein said second isolation and flow direction control plate has a different number of said fluid slots than said first isolation and flow direction control plate;

calculating a plurality of acceptable pressure losses through each of said smaller heat exchangers; and sizing said isolation and flow direction control plates to permit fluid flow within said acceptable pressure losses; and isolating and directing the fluid flow on the shell side of the heat exchanger assembly between each of said smaller heat exchangers.

11. The method according to claim 10, wherein each slot is a rectangular slot.

12. The method according to claim 10, further comprising:

varying a period of time during which the fluid flow on said shell side of the heat exchanger assembly resides in said smaller heat exchangers.

13. The method according to claim 10, wherein said isolation and flow direction control plates are rectangular plates.

14. The method according to claim 10, wherein said second isolation and flow direction control plate includes slots having different cross sectional areas.

15. A method of controlling a fluid flow to a turbine assembly, wherein said turbine assembly includes an integral heat exchanger assembly, said heat exchanger assembly including a shell; a plurality of tubes; a shell side fluid inlet; a shell side fluid outlet; at least one tube side fluid inlet; at least one tube side fluid outlet; wherein said shell side fluid inlet and said shell side fluid outlet are arranged in a cross flow fluid path with respect to each of said tube side fluid inlets, said method comprising:

creating a plurality of smaller heat exchangers by providing at least one isolation and flow direction control plate in a shell side of the heat exchanger assembly, wherein each of said isolation and flow direction control plates includes at least one fluid slot for permitting the fluid flow to pass through said isolation and flow direction control plate;

isolating and directing the fluid flow on the shell side of the heat exchanger assembly between each of said smaller heat exchanger; and operatively connecting said heat exchanger assembly to an inlet to a turbine assembly, said at least one fluid slot of said isolation and flow direction control plate positioned adjacent to said inlet of the turbine assembly, wherein said at least one isolation and flow direction control plate provided to create the plurality of smaller heat exchangers includes a first isolation and flow direction control plate having at least one of said fluid slots, and a second isolation and flow direction control plate having at least one of said fluid slots, wherein said second isolation and flow direction control plate has a different number of said fluid slots than said first isolation and flow direction control plate.

* * * * *